US007918041B2

(12) United States Patent
Cho

(10) Patent No.: US 7,918,041 B2
(45) Date of Patent: Apr. 5, 2011

(54) FOOTWEAR COOLING SYSTEM

(75) Inventor: Jang Rae Cho, Busan (KR)

(73) Assignee: NIKE, Inc., Beaverton, OR (US)

( * ) Notice: Subject to any disclaimer, the term of this patent is extended or adjusted under 35 U.S.C. 154(b) by 846 days.

(21) Appl. No.: 11/849,512

(22) Filed: Sep. 4, 2007

(65) Prior Publication Data

US 2009/0056172 A1 Mar. 5, 2009

(51) Int. Cl.
*A43B 7/06* (2006.01)
*A43B 13/18* (2006.01)

(52) U.S. Cl. ..... 36/3 B; 36/28

(58) Field of Classification Search ..... 36/3 B, 36/28, 29, 3 R, 30 R
See application file for complete search history.

(56) References Cited

U.S. PATENT DOCUMENTS

| | | | |
|---|---|---|---|
| 30,391 | A | 10/1860 | Dexter |
| 41,879 | A | 3/1864 | Webb |
| 60,987 | A | 1/1867 | Ayer |
| 363,377 | A | 5/1887 | Faye, Jr. |
| 379,579 | A | 3/1888 | Jensen |
| 387,335 | A | 8/1888 | Barker |
| 418,966 | A | 1/1890 | Welander |
| 452,655 | A | 5/1891 | Valiant |
| 485,180 | A | 11/1892 | Eastman |
| 556,825 | A | 3/1896 | King |
| 570,814 | A | 11/1896 | Owen |
| 578,794 | A | 3/1897 | Warner |
| 592,822 | A | 11/1897 | Parker |
| 660,552 | A | 10/1900 | Sharood |
| 746,862 | A | 12/1903 | Matson |
| 853,336 | A | 5/1907 | Ball |
| 896,488 | A | 8/1908 | Valiant |
| 940,856 | A | 11/1909 | Critz, Jr. |
| 1,029,110 | A | 6/1912 | Drobinski |
| 1,106,986 | A | 8/1914 | Stucki |
| 1,138,557 | A | 5/1915 | Gustaveson |
| 1,535,207 | A | 4/1925 | Dorff |
| 1,540,430 | A | 6/1925 | Sims |
| 1,616,254 | A | 2/1927 | De Suarez |
| 1,696,457 | A | 12/1928 | Shanahan |
| 1,797,309 | A | 3/1931 | Wojciechowski |
| 1,828,320 | A | 10/1931 | Daniels |
| 1,932,557 | A | 10/1933 | Meucci |
| 1,981,300 | A | 11/1934 | Berg |
| 1,994,681 | A | 3/1935 | Blumenfeld |
| 2,098,412 | A | 11/1937 | Bovay |
| 2,153,304 | A | 4/1939 | Gruber |
| 2,200,849 | A | 5/1940 | Margolin |
| 2,334,719 | A | 11/1943 | Margolin |
| 2,344,762 | A | 3/1944 | Wylie |
| 2,347,207 | A | 4/1944 | Margolin |

(Continued)

FOREIGN PATENT DOCUMENTS

| | | |
|---|---|---|
| CH | 198691 | 7/1938 |

(Continued)

*Primary Examiner* — Ted Kavanaugh
(74) *Attorney, Agent, or Firm* — Plumsea Law Group, LLC

(57) ABSTRACT

An article of footwear including a cooling system is disclosed. The article of footwear includes a sole system. The sole system includes a first compression chamber and a second compression chamber, each configured to compress during motion. The compression of the first compression chamber and the second compression chamber creates a pressure imbalance that facilitates the exchange of air throughout the article of footwear by means of apertures disposed along the upper sole portion, and channels configured to transfer air to the apertures.

11 Claims, 9 Drawing Sheets

U.S. PATENT DOCUMENTS 2,356,490 A 8/1944 Crotty
2,432,533 A 12/1947 Margolin
2,434,024 A 1/1948 Vlasak
2,437,065 A 3/1948 Austin
2,457,944 A 1/1949 Vlastos
2,558,973 A 7/1951 Meaker
2,614,339 A 10/1952 Herceg
2,720,041 A 10/1955 Kajtar
2,722,063 A 11/1955 Drefvelin
2,725,645 A 12/1955 Scala
2,751,692 A 6/1956 Cortina
2,884,716 A 5/1959 Shelare et al.
3,086,301 A 4/1963 Pastor
3,256,621 A 6/1966 Linton
3,383,782 A 5/1968 McGinnity
3,426,455 A 2/1969 Drago
3,555,709 A 1/1971 Raffaelli, Sr.
3,574,958 A 4/1971 Martuch et al.
3,863,272 A 2/1975 Guille
4,000,566 A 1/1977 Famolare, Jr.
4,005,531 A 2/1977 Weintraub et al.
4,063,371 A 12/1977 Batra
4,078,321 A 3/1978 Famolare, Jr.
4,112,599 A 9/1978 Krippelz
4,134,955 A 1/1979 Hanrahan, Jr. et al.
4,151,660 A 5/1979 Yoshimi et al.
4,215,492 A 8/1980 Sandmeier
4,222,183 A 9/1980 Haddox
4,290,211 A 9/1981 Csengeri
4,297,796 A 11/1981 Stirtz et al.
4,408,401 A 10/1983 Seidel et al.
4,438,573 A 3/1984 McBarron
4,485,568 A 12/1984 Landi et al.
4,507,880 A 4/1985 Ohashi
4,571,853 A 2/1986 Medrano
4,619,055 A 10/1986 Davidson
4,635,385 A 1/1987 Ogden
4,654,982 A 4/1987 Lee
4,679,335 A 7/1987 Berlese
4,693,021 A 9/1987 Mazzarolo
4,739,765 A 4/1988 Sydor et al.
4,754,559 A 7/1988 Cohen
4,776,110 A 10/1988 Shiang
4,813,160 A 3/1989 Kuznetz
4,831,749 A 5/1989 Tsai
4,835,883 A 6/1989 Tetrault et al.
4,837,948 A 6/1989 Cho
4,864,738 A 9/1989 Horovitz
4,893,418 A 1/1990 Ogden
4,894,932 A 1/1990 Harada et al.
4,896,440 A 1/1990 Salaverria
4,897,936 A * 2/1990 Fuerst ..... 36/30 A
4,899,465 A 2/1990 Bleimhofer et al.
4,899,467 A 2/1990 Mackey
4,910,887 A 3/1990 Turner et al.
4,912,858 A 4/1990 Mochizuki
4,939,851 A 7/1990 Miller
4,979,317 A 12/1990 Fukuoka
4,993,173 A 2/1991 Gardiner
5,035,068 A 7/1991 Biasi
5,044,096 A 9/1991 Polegato
5,171,033 A 12/1992 Olson et al.
5,235,761 A 8/1993 Chang
5,295,312 A 3/1994 Blumberg et al.
5,317,819 A 6/1994 Ellis, III
5,319,866 A 6/1994 Foley et al.
5,341,581 A 8/1994 Huang
5,342,070 A 8/1994 Miller et al.
5,357,689 A 10/1994 Awai
5,367,788 A 11/1994 Chen
5,367,791 A * 11/1994 Gross et al. ..... 36/31
5,390,430 A 2/1995 Fitchmun et al.
5,465,508 A 11/1995 Bourdeau
5,499,459 A 3/1996 Tomaro
5,505,011 A 4/1996 Bleimhofer
5,551,172 A 9/1996 Yu
5,584,130 A 12/1996 Perron
5,588,226 A 12/1996 Schenkel
5,598,644 A 2/1997 Polegato
5,607,745 A 3/1997 Ogden
5,611,152 A 3/1997 Richard et al.
5,619,809 A * 4/1997 Sessa ..... 36/3 R
5,655,314 A 8/1997 Petracci
5,664,343 A 9/1997 Byrne
5,685,091 A 11/1997 Yalamanchili
5,697,171 A 12/1997 Phillips
5,699,627 A 12/1997 Castro
5,714,229 A 2/1998 Ogden
5,738,937 A 4/1998 Baychar
5,775,005 A * 7/1998 McClelland ..... 36/31
5,797,610 A 8/1998 Grande et al.
5,815,949 A * 10/1998 Sessa ..... 36/3 B
5,826,349 A 10/1998 Goss
5,845,418 A 12/1998 Chi
5,852,884 A 12/1998 Miotto
5,946,824 A 9/1999 Tighe et al.
5,955,172 A 9/1999 Hurten
5,979,076 A 11/1999 Li
5,983,524 A 11/1999 Polegato
5,983,525 A 11/1999 Brown
5,992,052 A 11/1999 Moretti
5,996,250 A 12/1999 Reed et al.
6,006,447 A 12/1999 Neal et al.
6,012,236 A 1/2000 Pozzobon
6,032,388 A 3/2000 Fram
6,041,518 A 3/2000 Polycarpe
6,041,519 A 3/2000 Cheng
6,085,444 A 7/2000 Cho
6,196,556 B1 3/2001 Bonaventure et al.
6,305,100 B1 10/2001 Komarnycky
6,330,757 B1 * 12/2001 Russell ..... 36/28
6,416,610 B1 7/2002 Matis et al.
6,446,360 B1 9/2002 Sheets et al.
6,562,271 B2 5/2003 Hiraoka et al.
6,594,918 B2 7/2003 Hatfield et al.
6,681,500 B2 1/2004 Moretti
6,817,112 B2 11/2004 Berger et al.
6,948,260 B2 9/2005 Lin et al.
6,976,319 B2 12/2005 Pfander
2002/0011009 A1 1/2002 Pan
2002/0012784 A1 1/2002 Norton et al.
2002/0078593 A1 6/2002 Pavelescu et al.
2002/0166262 A1 11/2002 Hernandez
2003/0136024 A1 7/2003 Su
2005/0126036 A1 * 6/2005 Wu ..... 36/3 B
2005/0172513 A1 8/2005 Lechhart et al.
2009/0193690 A1 * 8/2009 Moretti ..... 36/3 B

FOREIGN PATENT DOCUMENTS

DE 20808 4/1882
DE 203734 4/1908
DE 3225451 7/1982
DE 121957 10/1990
DE 9208875.9 10/1992
DE 4128704 3/1993
DE 19937334 10/2001
EP 0350611 1/1990
EP 0857433 8/1998
EP 0927524 7/1999
EP 0956789 11/1999
EP 0960579 12/1999
FR 1142786 9/1957
GB 395221 7/1933
GB 2183140 6/1987
GB 2315010 1/1998
IT 352511 9/1937
JP 9248203 9/1997
JP 2001029110 2/2001
WO WO 9406317 3/1994
WO WO 9728711 8/1997
WO WO 9851177 11/1998
WO WO 9966812 12/1999

* cited by examiner

FOOTWEAR COOLING SYSTEM

BACKGROUND OF THE INVENTION

1. Field of the Invention

The present invention relates generally to footwear, and in particular a cooling system for an article of footwear.

2. Description of Related Art

Articles of footwear with ventilation systems have been proposed. In general, cooling or ventilation systems included in articles of footwear may be divided into two categories: those passively allowing air exchange and those including a mechanism for actively facilitating air exchange.

The following references teach passive systems. Moretti (U.S. Pat. No. 5,992,052) discloses a shoe with a vapor permeable insole that also includes a waterproof membrane. Polegato (U.S. Pat. No. 5,983,524) discloses a similar vapor-permeable shoe that is also water proof. Lechhart et al. (U.S. patent number 2005/0172513) disclose a breathable sole structure for footwear. The footwear sole structure includes an insole, an outsole, and a functional membrane system.

Berger et al. (U.S. Pat. No. 6,817,112) teaches an article of footwear that includes openings for ventilation and vapor exchange. The sole of Berger's design includes at least three layers. Each of the layers has one or more openings, so that ventilation and air exchange may occur within the article of footwear. The partial overlapping of these holes provides a substantially larger number of openings without reducing the mechanical stability of the shoe. Although these references teach the concept of allowing air to be transferred through the insole or a membrane in the article of footwear, there is no mechanism for facilitating the flow of air.

Articles of footwear including provisions for actively facilitating air exchange have been disclosed. Pfander (U.S. Pat. No. 6,976,319) discloses an article of footwear that includes a midsole having a front portion with a plurality of spaced holes that are vertically aligned to allow airflow through the midsole. In particular, the plurality of spaced holes are aligned with a set of moguls in the outsole for the purpose of providing air flow through the midsole when the moguls are deformed by the weight and walking action of the wearer. Generally, however, the holes in the midsole are positioned only in the forefoot region. Furthermore, the air is not channeled directly to the holes, but rather the holes are in contact with a large space, and the moguls deform within that large space. This design lacks an efficient means of circulating the air directly throughout the entirety of the midsole.

Huang (U.S. Pat. No. 5,341,581) discloses a compression cooling system of a shoe midsole comprising mainly a main body, an air sac and an air duct. During typical use, the air duct of the Huang device, which is disposed along the heel, is compressed and circulates air through the air duct. Air is transported through the air duct to an air slot and four air holes, disposed along the forefoot of the midsole. This design requires an air admitting one-way valve and an air discharging one-way valve. In addition, the air holes in the midsole are not distributed throughout the midsole, but only in the forefoot portion. The design of Huang requires a large number of components in order to achieve ventilation of the foot through the midsole and outsole and does not include holes for ventilation throughout the entirety of the midsole.

There is a need in the art for an article of footwear incorporating a simple design, eliminating the need for multiple layers and valves, and a design that simultaneously incorporates multiple holes disposed along the midsole to provide ventilation to the entire length of the article of footwear.

SUMMARY OF THE INVENTION

A footwear cooling system is disclosed. In one aspect, the invention provides an article of footwear comprising: an upper; an upper sole portion including an upper sole portion body and a projecting portion extending from a first side of the upper sole portion body; the upper sole portion including at least one aperture; a lower sole portion including a hole, configured to receive the upper sole portion; a compression chamber defined by a lower surface of the projecting portion and at least one side wall of the hole disposed in the outsole; the compression chamber having a first volume; and where the compression chamber has a second volume after being compressed and wherein the change in volume forces air through the at least one aperture.

In another aspect, the upper sole portion includes a first projecting portion and a second projecting portion.

In another aspect, the first projecting portion corresponds to a forefoot region of the upper sole portion.

In another aspect, the second projecting portion corresponds to a heel region of the upper sole portion.

In another aspect, the outsole includes at least one channel.

In another aspect, the channel corresponds to the aperture.

In another aspect, the invention provides an article of footwear, comprising: an upper; an upper sole portion including at least one projecting portion on a first side; a lower sole portion including a hole configured to receive the projecting portion; and where a first side of the projecting portion includes at least one tread element.

In another aspect, a first surface of the projecting portion is composed of a similar material as the outsole.

In another aspect, the outsole includes at least one tread element disposed along a second side.

In another aspect, the tread element disposed along the projecting portion is composed of the same material as the tread element disposed along the outsole.

In another aspect, the first side of the projecting portion includes multiple tread elements.

In another aspect, the tread element disposed along a first side of the projecting portion increases traction between the article of footwear and a surface.

In another aspect, the upper sole portion includes a second projecting portion, including a second tread element disposed along a first side of the second projecting portion.

In another aspect, the invention provides an article of footwear, comprising: an upper and an upper sole portion; a hole disposed on a lower sole portion configured to receive a portion of the upper sole portion; the outsole including an outer surface on a first side; and where the first portion of the upper sole portion approaches the outer surface of the outsole when a predetermined force is applied to the upper sole portion.

In another aspect, the first portion of the upper sole portion is co-planar with the outer surface of the outsole.

In another aspect, the first portion of the upper sole portion corresponds to a projecting portion of the upper sole portion.

In another aspect, the predetermined force is applied by means of a wearer stepping down with an article of footwear.

In another aspect, the first portion of the upper sole portion recedes from the outer surface of the outsole once a predetermined force has been applied and then released.

In another aspect, the upper sole portion includes a second portion, and the outsole includes a second hole configured to receive the second portion of the upper sole portion.

In another aspect, the second portion of the upper sole portion approaches the outer surface of the outsole when a predetermined force is applied.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
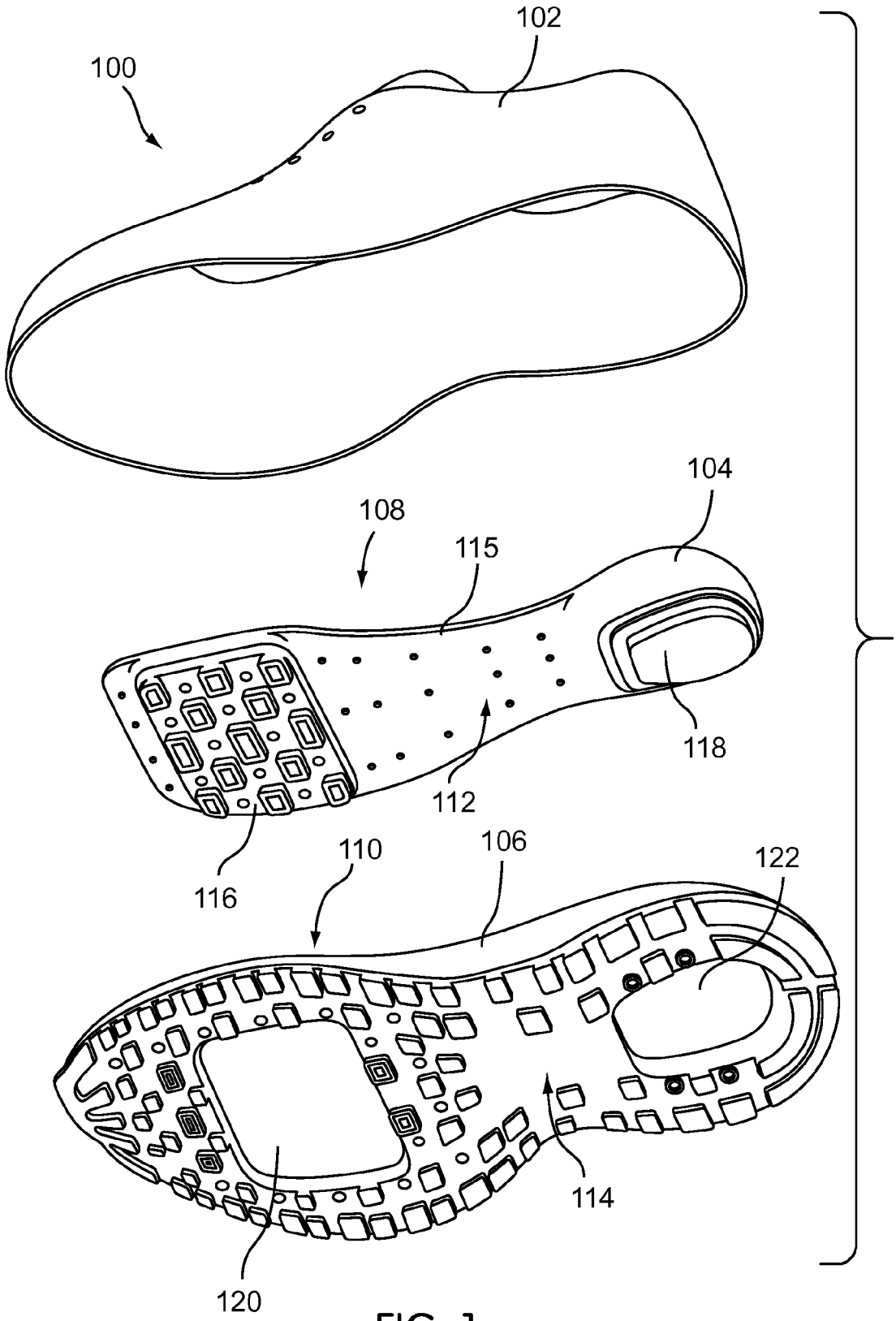
FIG. 1 is an isometric exploded view of a preferred embodiment of an article of footwear.

An article of footwear with a cooling system is disclosed. The cooling system comprises an outsole, including channels, and an upper sole portion including apertures. FIG. 1 is an exploded isometric view of a preferred embodiment of an article of footwear 100. Article of footwear 100 preferably includes upper 102. Upper 102 may be constructed of any material. Although upper 102 is shown generically in this embodiment, in general upper 102 may comprise any shape and/or design. In a preferred embodiment, article of footwear 100 further includes upper sole portion 104. A first side 108 of upper sole portion 104 is preferably disposed proximate to a wearer's foot once the wearer's foot has been inserted. Upper sole portion 104 preferably includes upper sole portion body 115. Upper sole portion 104 also preferably includes a first projecting portion 116 and a second projecting portion 118. First projecting portion 116 and second projecting portion 118 preferably project outward with respect to a second side 112 of upper sole portion body 115. In some embodiments, upper sole portion 104 may include more than two projecting portions. In other embodiments, upper sole portion 104 may include only one projecting portion.

In a preferred embodiment, article of footwear 100 also includes lower sole portion 106. A first side 110 of lower sole portion 106 is preferably configured to contact second side 112 of upper sole portion body 115. A second side 114 of lower sole portion 106 is preferably configured to contact the ground. In a preferred embodiment, lower sole portion 106 includes a first hole 120 and a second hole 122. First hole 120 and second hole 122 may be different sizes. In a preferred embodiment, first hole 120 is slightly larger than second hole 122. In some embodiments, lower sole portion 106 may include more than two holes. In other embodiments, lower sole portion 106 may include only one hole.

In a preferred embodiment, first hole 120 and second hole 122 are configured to receive first projecting portion 116 and second projecting portion 118, respectively. That is, once upper sole portion 104 and lower sole portion 106 are assembled, first projecting portion 116 sits within first hole 120 and second projecting portion 118 sits within second hole 122. In a preferred embodiment, the depth of first hole 120 is preferably greater than the height of first projecting portion 116. Likewise, the depth of second hole 122 is preferably greater than the height of second projecting portion 118. With this arrangement second side 114 of lower sole portion 106 may be in contact with the ground. However, neither first projecting portion 116 nor second projecting portion 118 will initially contact the ground. Instead, a small gap will be left between each projecting portion and the ground.

Figure 2:
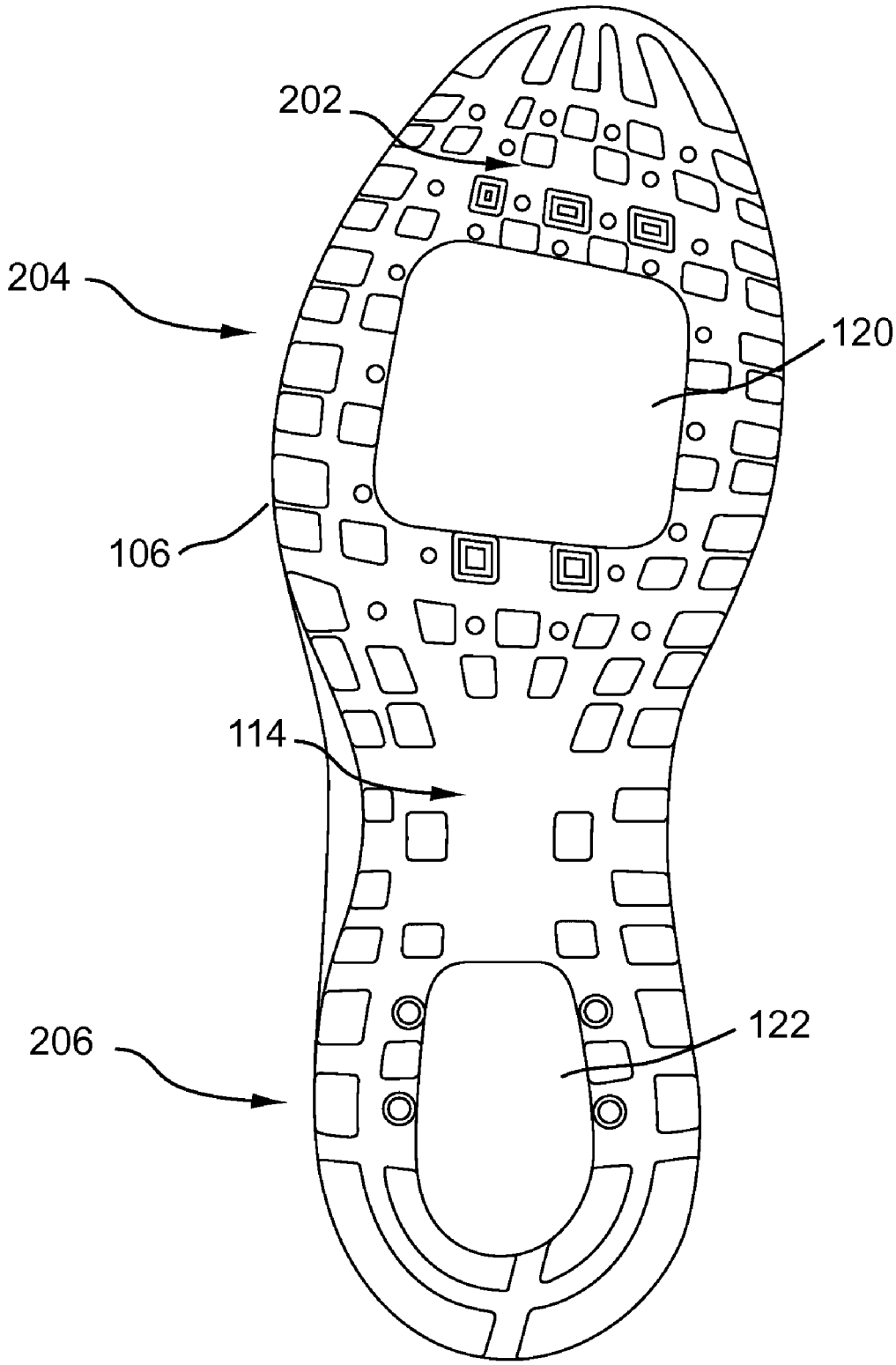
FIG. 2 is a plan view of a preferred embodiment of the bottom of an outsole.

It is common for outsoles to include provisions for providing traction between an article of footwear and a surface. In a preferred embodiment, lower sole portion 106 may include tread elements. The tread elements may be composed of a similar material to second side 114 of lower sole portion 106, or may be composed of a different material. In some embodiments, tread elements may be composed of rubber. FIG. 2 is a plan view of a preferred embodiment of second side 114 of lower sole portion 106. In this embodiment, lower sole portion 106 includes tread elements 202. Second side 114 of lower sole portion 106 preferably includes first hole 120 and second hole 122. In some embodiments, first hole 120 is disposed along a forefoot region 204 of lower sole portion 106. Likewise, second hole 122 may be disposed along a heel region 206 of lower sole portion 106. In a preferred embodiment, first hole 120 and second hole 122 extend through to first side 110 (see FIG. 3) of lower sole portion 106.

Figure 3:
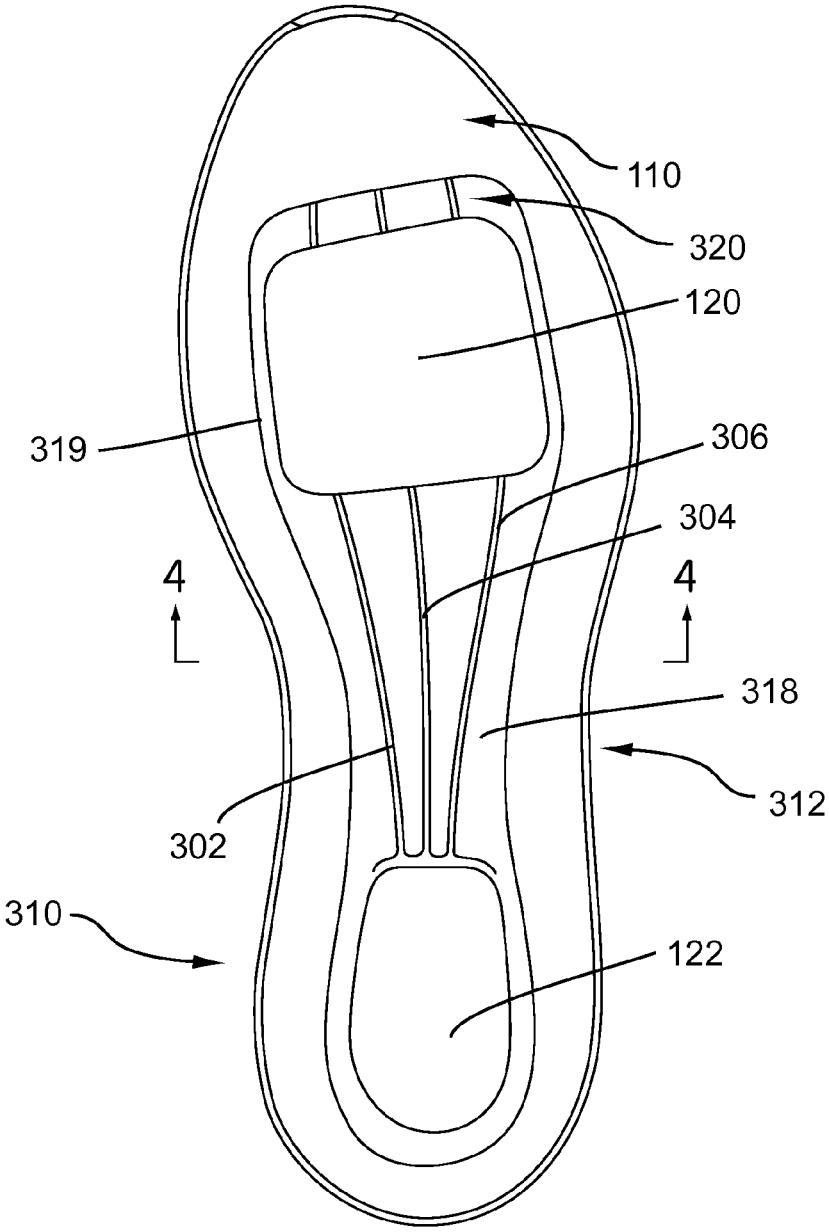
FIG. 3 is a plan view of a preferred embodiment of the top of an outsole.

FIG. 3 is a plan view of a preferred embodiment of first side 110 of lower sole portion 106. As disclosed above, first hole 120 and second hole 122 preferably extend through lower sole portion 106 to first side 110. First hole 120 and second hole 122 can be observed in FIG. 3. In some embodiments, lower sole portion 106 includes recessed region 318, disposed proximate to first hole 120 and second hole 122, and bounded by periphery 319. Recessed region 318 is preferably a portion of lower sole portion 106 that is configured to receive upper sole portion 104 in a manner that allows first side 108 of upper sole portion 104 to be flush with first side 110 of lower sole portion 106 after upper sole portion 106 is mounted.

In a preferred embodiment, lower sole portion 106 may include one or more channels that facilitate the transport of air to various portions of the upper sole portion. In the exemplary embodiment, lower sole portion 106 includes first channel 302, second channel 304, and third channel 306. First channel 302 may be disposed closest to a medial side 310 of lower sole portion 106. Second channel 304 may be disposed along the center of lower sole portion 106. Third channel 306 may be disposed closest to a lateral side 312 of lower sole portion 106.

In some embodiments, first channel 302, second channel 304 and third channel 306 are all narrow grooves formed into first side 110 of lower sole portion 106. In some embodiments, first channel 302, second channel 304, and third channel 306 may be tubes or ducts that are fitted to lower sole portion 106. Generally, any conduit or medium that permits this transfer of air can be used as a channel. In a preferred embodiment, first channel 302, second channel 304, and third channel 306 each extend between second hole 122 and first hole 120. Additionally, each channel preferably extends through forward portion 320 of recession region 318.

In general, lower sole portion 106 may include any number of channels. These channels are preferably configured to allow air to flow through them. As air initially enters article of footwear 100 through first hole 120 and second hole 122, first channel 302, second channel 304 and third channel 306 distribute the air across the entire length of article of footwear 100. In a preferred embodiment, each channel is configured to be open prior to the insertion of upper sole portion 104 into lower sole portion 106. Once upper sole portion 104 and lower sole portion 106 have been assembled, first channel 302, second channel 304, and third channel 306 are closed along their open side by upper sole portion 104. With this configuration, air is transported through the channels and air is delivered to predetermined locations that correspond to various apertures along upper sole portion 104.

Figure 4:
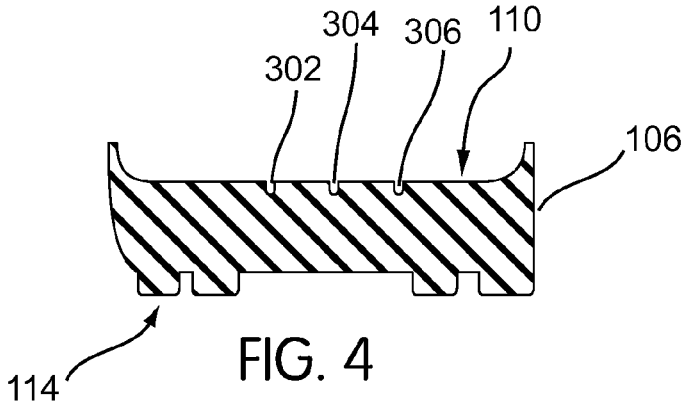
FIG. 4 is a cross sectional view of a preferred embodiment of an outsole.

FIG. 4 is a cross-sectional view of a preferred embodiment of lower sole portion 106. Second side 114 of lower sole portion 106 is preferably configured to contact a surface. First side 110 of lower sole portion 106, which includes first channel 302, second channel 304, and third channel 306, is preferably configured to contact the upper sole portion. The shape of each channel is seen to be semi-circular in this embodiment. In other embodiments, the shape of the channels may vary. Additionally, the depth of each channel may be varied. In a preferred embodiment, the depth of each channel is substantially less than the thickness of lower sole portion 106.

Figure 5:
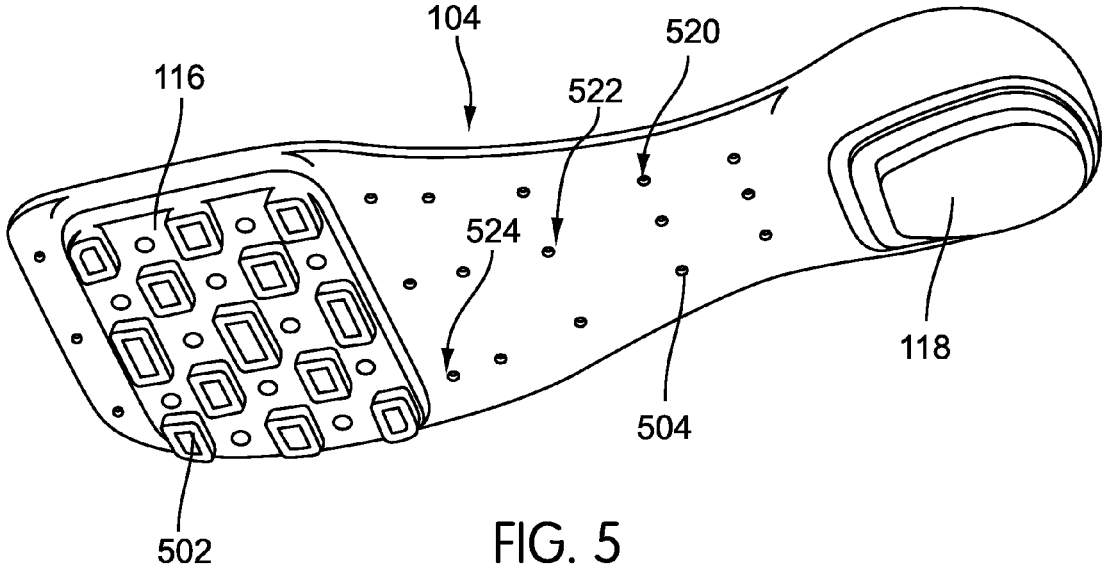
FIG. 5 is an isometric view of a preferred embodiment of an upper sole portion.

Referring to FIG. 5, a preferred embodiment of upper sole portion 104 includes apertures 504. Preferably, apertures 504 facilitate the transfer of air between the lower sole portion and the inside of an article of footwear. In some embodiments, apertures 504 may be disposed into three groups. In the exemplary embodiment, a first group 520, a second group 522, and a third group 524 of apertures are disposed lengthwise along upper sole portion 104. Preferably, first group 520, second group 522, and third group 524 are associated with the first channel, the second channel, and the third channel of the lower sole portion 106, respectively.

As previously disclosed, upper sole portion 104 preferably includes first projecting portion 116 and second projecting portion 118. First projecting portion 116 preferably includes provisions for applying traction to the ground. In a preferred embodiment, first projecting portion 116 may include tread elements 502. Tread elements 502 may be composed of a similar material to first projecting portion 116 or they may be composed of a different material than first projecting portion 116. In some embodiments, second projecting portion 118 may also include tread elements.

Figure 6:
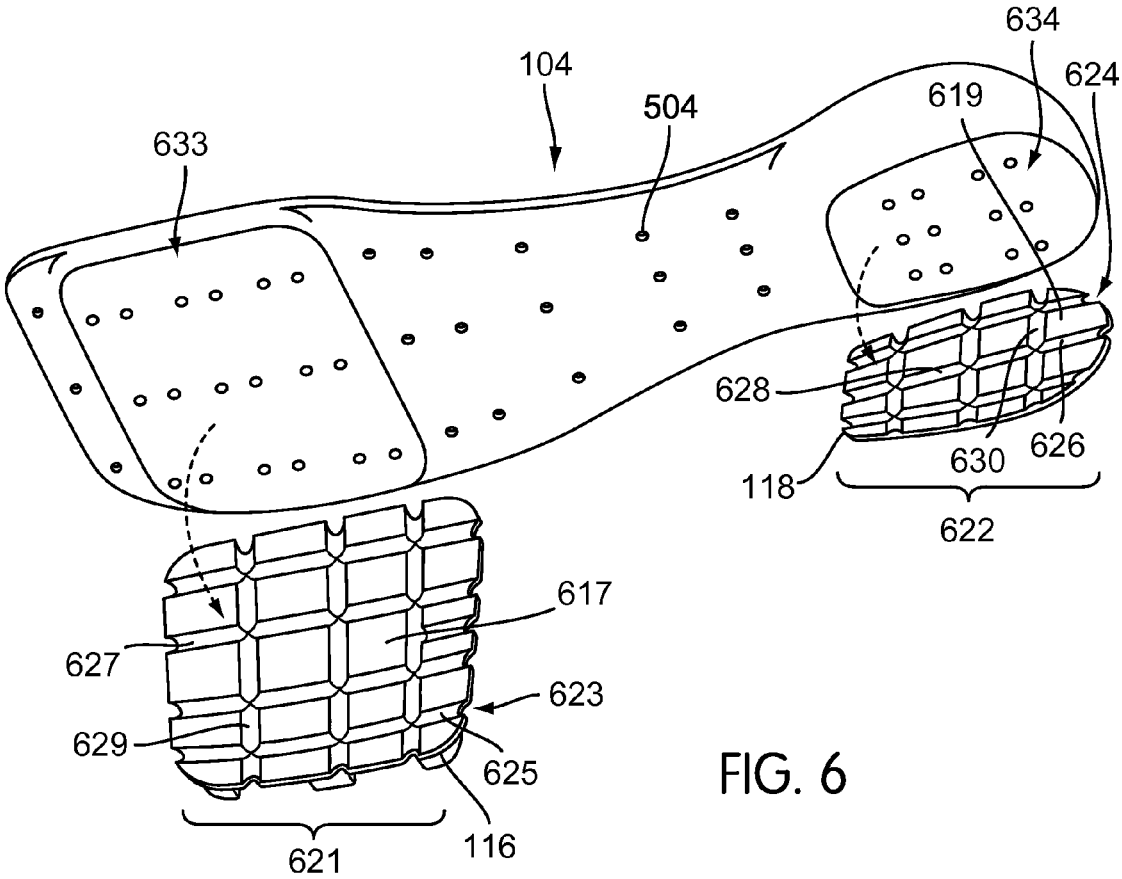
FIG. 6 is an isometric view of a preferred embodiment of an upper sole portion.

In some embodiments, first projecting portion 116 and second projecting portion 118 may include provisions for receiving and distributing air across upper sole portion 104. Referring to FIG. 6, first upper surface 617 and second upper surface 619 of projecting portions 116 and 118, respectively, may include air distribution systems.

In the exemplary embodiment, first projecting portion 116 may include first air distribution system 621 disposed on first upper surface 617. Preferably, first air distribution system 621 includes first air inlet portions 623 and intersecting channels 625. Intersecting channels 625 may include first set of air distribution channels 627 that are oriented longitudinally and second set of air distribution channels 629 that are distributed laterally. Intersecting channels 625 may be disposed just under first aperture set 633 of apertures 504.

Figure 9:
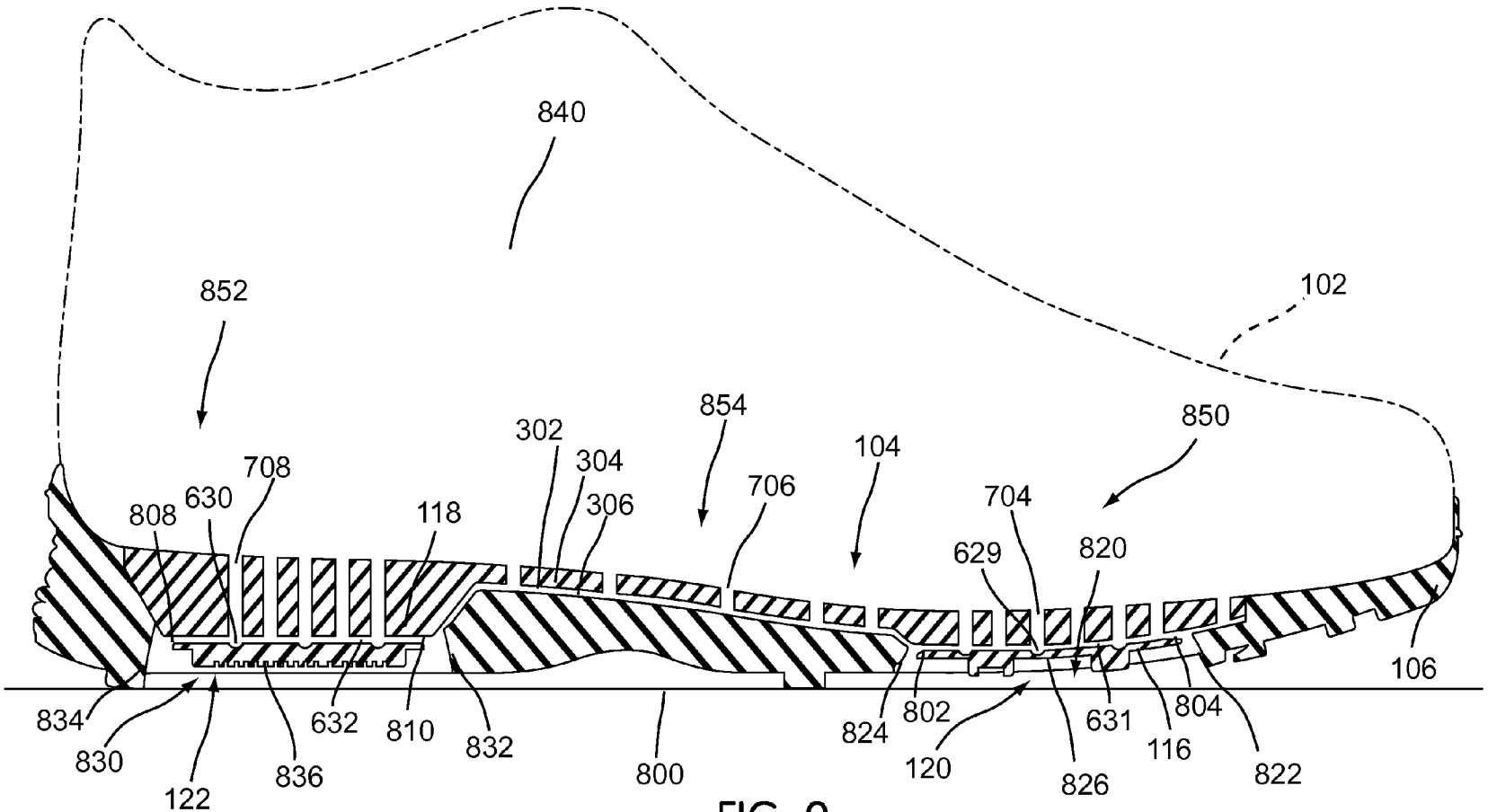
FIG. 9 is a side view of a preferred embodiment of a sole system before compression.

In this preferred embodiment, first air inlet portions 623 are semi-circular and are configured to place outside air in fluid communication with intersecting channels 625 as well as first air distribution cavity 631 disposed between first projecting portion 116 and upper sole portion 104 (see FIG. 9). Preferably, first set of air distribution channels 627 are configured to coincide with channels 302, 304 and 306 of upper sole portion 104 (see FIG. 3). With this preferred arrangement, air may be evenly distributed under upper sole portion 104 and under apertures 504.

In a preferred embodiment, second projecting portion 118 may include second air distribution system 622 disposed on second upper surface 619. This arrangement is preferably similar to the arrangement of first air distribution system 621 on first upper surface 617 of first projecting portion 116. Preferably, second air distribution system 622 includes second air inlet portions 624 and intersecting channels 626. Intersecting channels 626 may include third set of air distribution channels 628 that are oriented longitudinally and fourth set of air distribution channels 630 that are distributed laterally. Intersecting channels 626 may be disposed just under second aperture set 634 of apertures 504.

In this preferred embodiment, second air inlet portions 624 are semi-circular and are configured to place outside air in fluid communication with intersecting channels 626 as well as second air distribution cavity 632 disposed between second projecting portion 118 and upper sole portion 104 (see FIG. 9). Preferably, second set of air distribution channels 628 are also configured to coincide with channels 302, 304 and 306 of upper sole portion 104 (see FIG. 3). With this preferred arrangement, air may be evenly distributed under upper sole portion 104 and under apertures 504.

Figure 7:
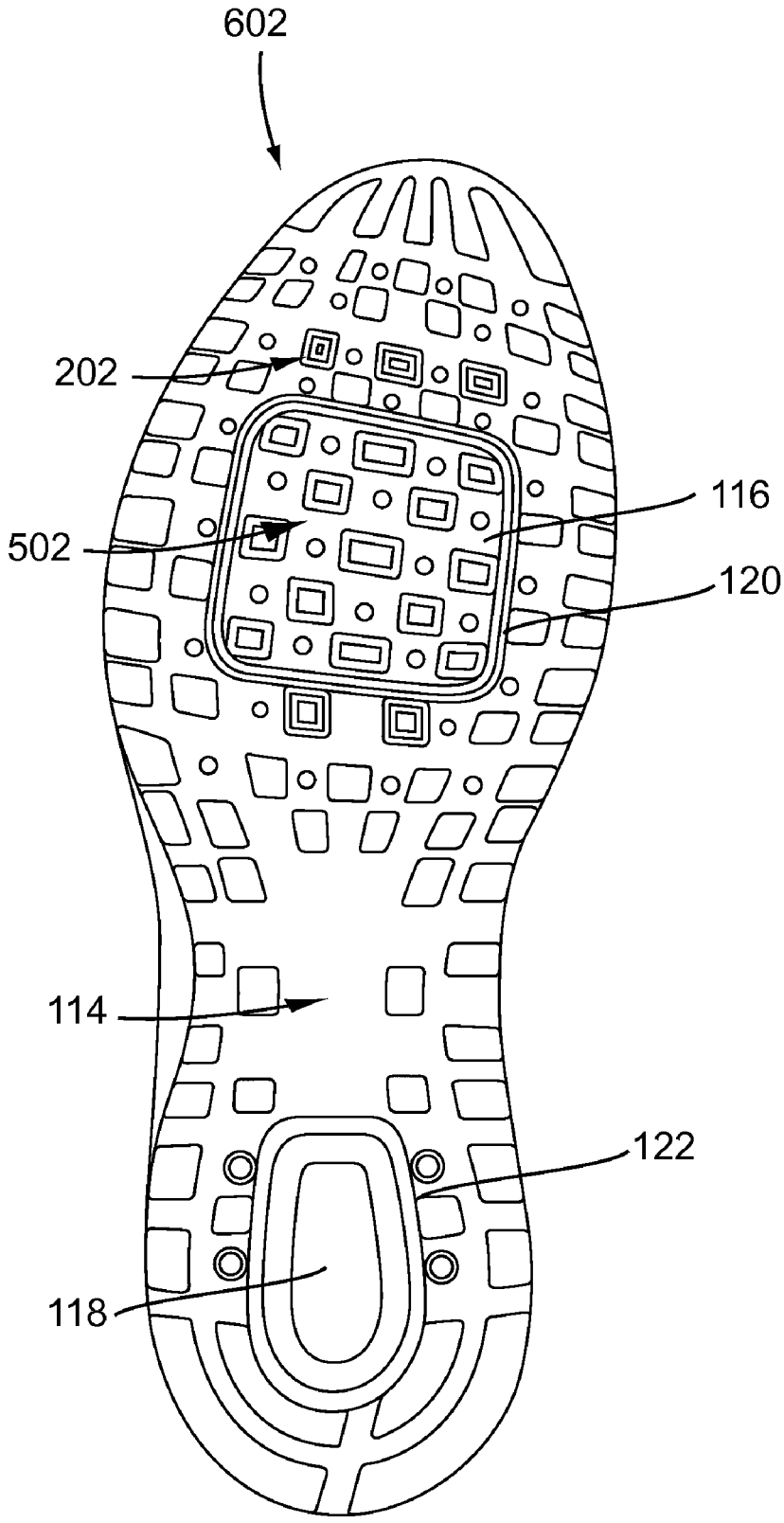
FIG. 7 is a plan view of a preferred embodiment of the bottom of a sole system.

In this specification and throughout the claims, a combination of the lower sole portion with the upper sole portion is referred to as a sole system. FIG. 7 is a plan view of a preferred embodiment of sole system 602, from below. Sole system 602 includes tread elements 202 of lower sole portion 106 and tread elements 502 of upper sole portion 104. Here, first projecting portion 116 may be seen through first hole 120. Likewise, second projecting portion 118 may be seen through second hole 122.

Figure 8:
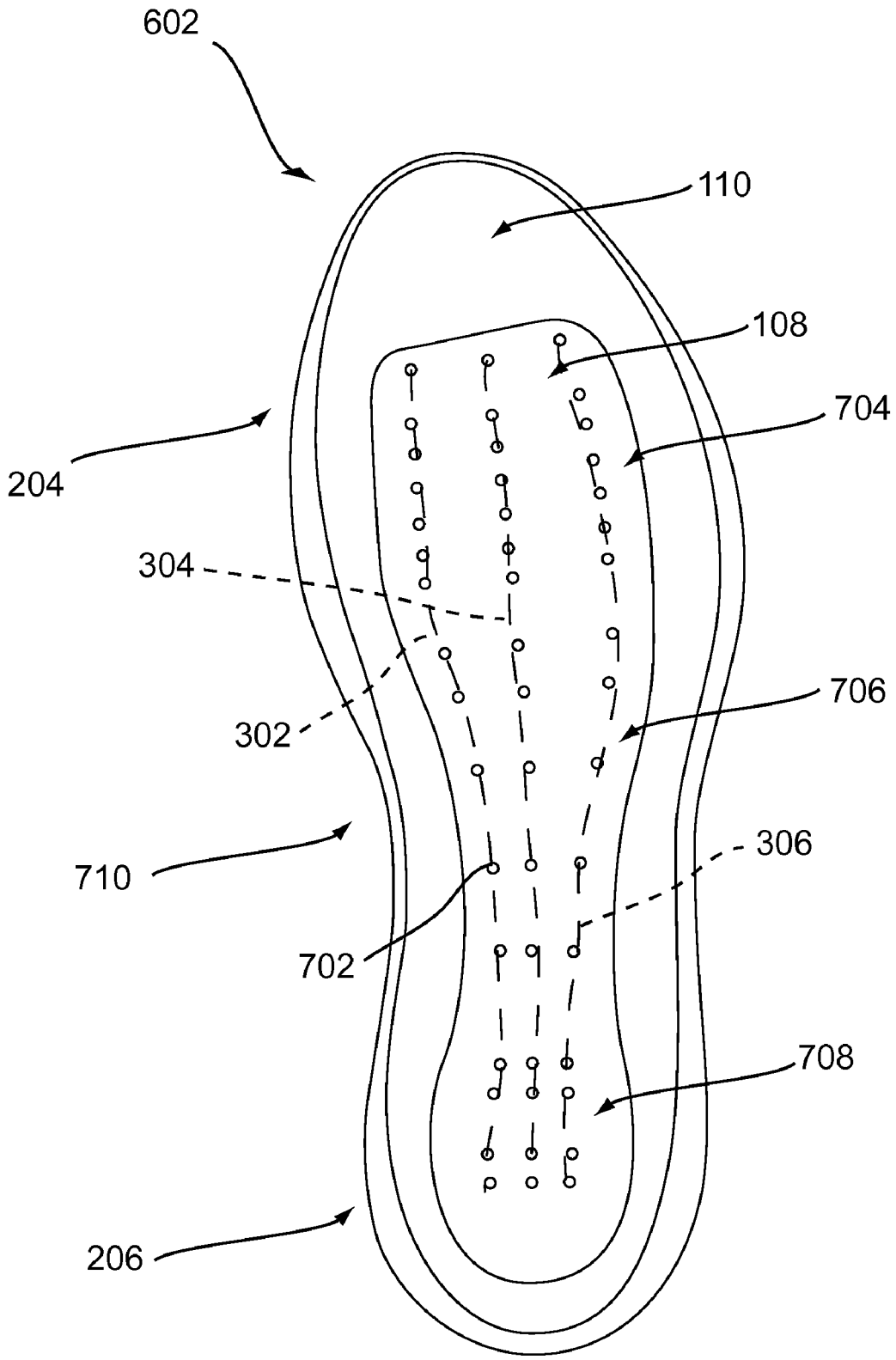
FIG. 8 is a plan view of a preferred embodiment of the top of a sole system.

FIG. 8 is top plan view of a preferred embodiment of sole system 602, from above. In this embodiment, first side 108 of upper sole portion 104 is seen to be coincident with first side 110 of lower sole portion 106. In some embodiments, first side 108 of upper sole portion 104 may be slightly raised or lowered with respect to first side 110 of lower sole portion 106. Upper sole portion 104 may include apertures 702, disposed along first side 108 of upper sole portion 104. In a preferred embodiment, apertures 702 are aligned just above channels in lower sole portion 106. That is, the apertures 702 are configured to be disposed in lines that coincide with first channel 302, second channel 304, and third channel 306 of lower sole portion 106. The positions of these channels are indicated in FIG. 8 by dotted lines.

In addition to being disposed along lines, apertures 702 may be divided into aperture regions. First aperture region 704 is preferably disposed along forefoot region 204 of lower sole portion 106. Second aperture region 706 is preferably disposed along middle region 710 of lower sole portion 106. Third aperture region 706 is preferably disposed along heel region 206 of lower sole portion 106. Each aperture region may function to exchange air at a different portion of the article of footwear.

As previously discussed, a system for facilitating air exchange between outside air and the air enclosed within the upper of an article of footwear is provided. This system preferably includes a set of compression chambers that are formed in the sole system. FIG. 9 is a side cross-sectional view of a preferred embodiment of an article of footwear in contact with surface 800. In FIG. 9, upper 102 is shown in phantom.

In a preferred embodiment, first projecting portion 116 and second projecting portion 118 of upper sole portion 104 are preferably set within first hole 120 and second hole 122 of lower sole portion 106. First lower surface 826 of first projecting portion 116 preferably defines a top portion of first compression chamber 820. Along the sides, first compression chamber 820 is preferably bounded by a first wall 822 and a second wall 824 of first hole 120. A third and fourth wall of first hole 120, not shown here, also bound first compression chamber 820.

In a similar manner to first compression chamber 820, the top of second compression chamber 830 is defined by second lower surface 836 of second projecting portion 118. The walls of second compression chamber 830 are defined by first wall 832 and second wall 834 of second hole 122. A third and fourth wall of first hole 122, not shown here, also bound second compression chamber 830.

In some embodiments, a compression chamber may not include four walls. In general, a compression chamber may be formed from a lower surface of a projecting portion and any number of walls of a hole disposed in an outsole. For example, a triangularly shaped compression chamber may include only three walls.

In a preferred embodiment, a bottom side of each compression chamber 820 and 830 is defined by surface 800. In other words, surface 800 serves as the bottom side of compression chambers 820 and 830. Furthermore, first compression chamber 820 and second compression chamber 830 each include an initial volume. Referring to FIG. 9, first compression chamber 820 is preferably in fluid communication with enclosure 840 of upper 102 by way of a system of apertures and a system of channels. In particular, first compression chamber 820 is preferably in fluid communication with forefoot region 850 of enclosure 840 via first aperture region 704.

Likewise, second compression chamber 830 is preferably in fluid communication with heel region 852 of enclosure 840 via third aperture region 708. In addition, first compression chamber 820 and second compression chamber 830 are both in fluid communication with middle region 854 of enclosure 840 via second aperture region 706. In particular, second aperture region 706 is in fluid communication with first compression chamber 820 and second compression chamber 830 via first channel 302, second channel 304 and third channel 306.

In some embodiments, first projecting portion 116 includes first inlet 802 and second inlet 804. Preferably, first inlet 802 and second inlet 804 allow air to be exchanged between first aperture region 704 and first compression chamber 820. Likewise, second projecting portion 118 preferably includes third inlet 808 and fourth inlet 810. Third inlet 808 and fourth inlet 810 preferably allow air to be exchanged between third aperture region 708 and second compression chamber 830.

Figure 10:
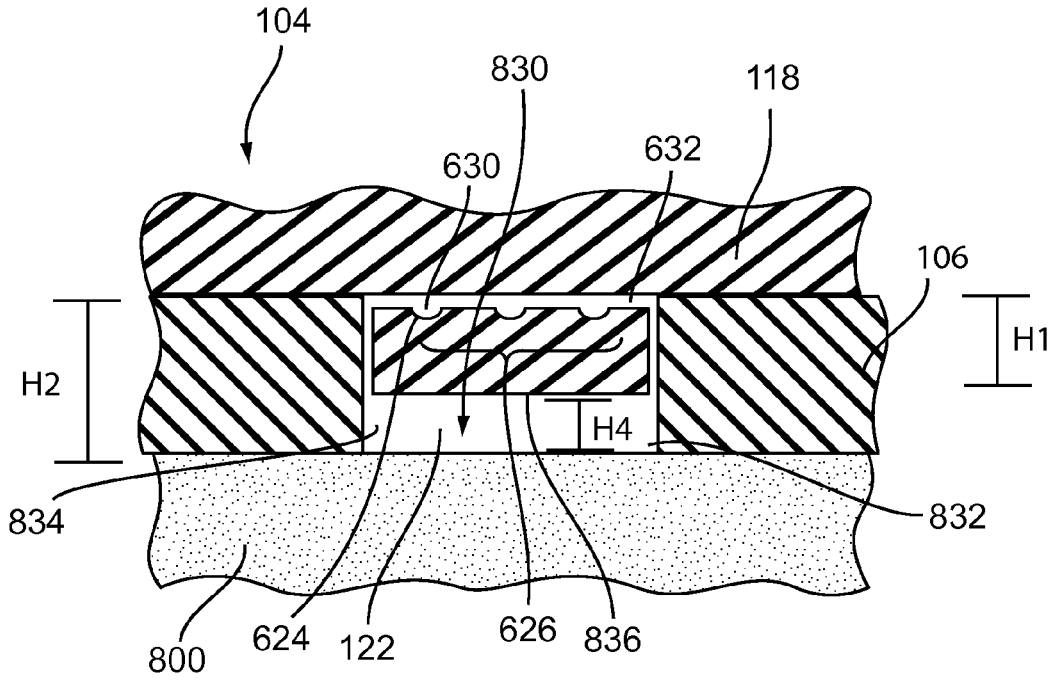
FIG. 10 is a schematic view of a preferred embodiment of a compression chamber before a force has been applied to the upper sole portion.
Figure 11:
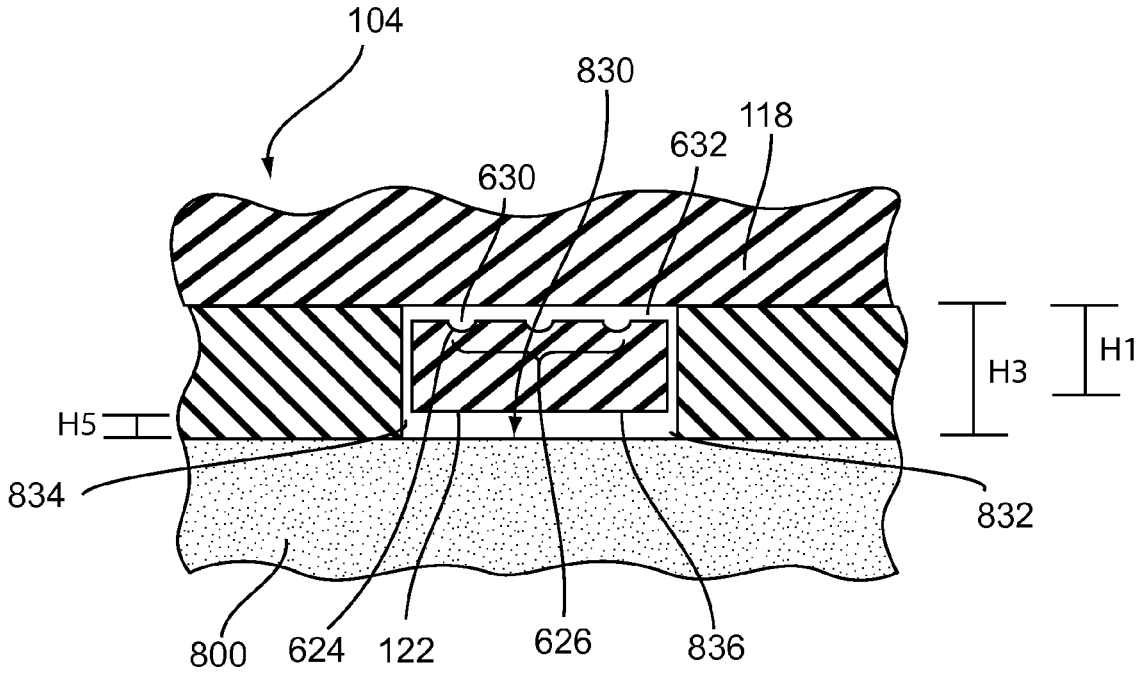
FIG. 11 is a schematic view of a preferred embodiment of a compression chamber after a force has been applied to the upper sole portion.

The reduction of the volume of air in second compression chamber 830 as a result of a force applied to the upper sole portion 104 is best understood by referring to FIGS. 10 and 11. FIG. 10 is a schematic diagram of a preferred embodiment of second compression chamber 830 prior to compression. Recall that second compression chamber 830 is defined by the walls of second hole 122. First wall 832 and second wall 834 can be seen in FIGS. 10 and 11. Third wall and fourth wall of second hole 122 are not shown in this cross sectional view. Second compression chamber 830 further includes lower surface 836 of second projecting portion 118 of upper sole portion 104. In this embodiment, second compression chamber 830 has a first initial volume.

Referring to FIG. 10, H1 is the height of second projecting portion 118. The initial height of lower sole portion 106, H2, can also be seen in FIG. 10. Before compression, the distance between second lower surface 836 of second projecting portion 118 and surface 800 is H4. As a force is applied to upper sole portion 104, preferably by a wearer's foot, second projecting portion 118 will move further into second hole 122. This is illustrated in the following figure.

FIG. 11 is a schematic diagram of a preferred embodiment of second compression chamber 830 during compression. Compression causes lower surface 836 to be lowered and approach surface 800. As the width of second compression chamber 830 stays relatively constant during the compression step, the volume of second compression chamber 830 is reduced from a first volume to a second volume. This can be observed by comparing FIG. 10 and FIG. 11. Here, the height of second projecting portion 118, H1, is the same. However, the height of lower sole portion 106, H3 has been reduced from its original value, H2. The weight of the wearer of article of footwear 100 bearing down on lower sole portion 106 can cause this compression. The compression of lower sole portion 106 causes the distance H5 between second lower surface 836 and surface 800 to be reduced when compared with initial distance H4, the distance prior to compression.

With this preferred arrangement, the motion of second lower surface 836 can assist in moving air to and from various parts of article of footwear 100. In particular, air enters at intake air passages 624 and moves through air distribution channels 626, including fourth set of air distribution channels 630. Preferably, air also moves through second air distribution cavity 632.

Figure 12:
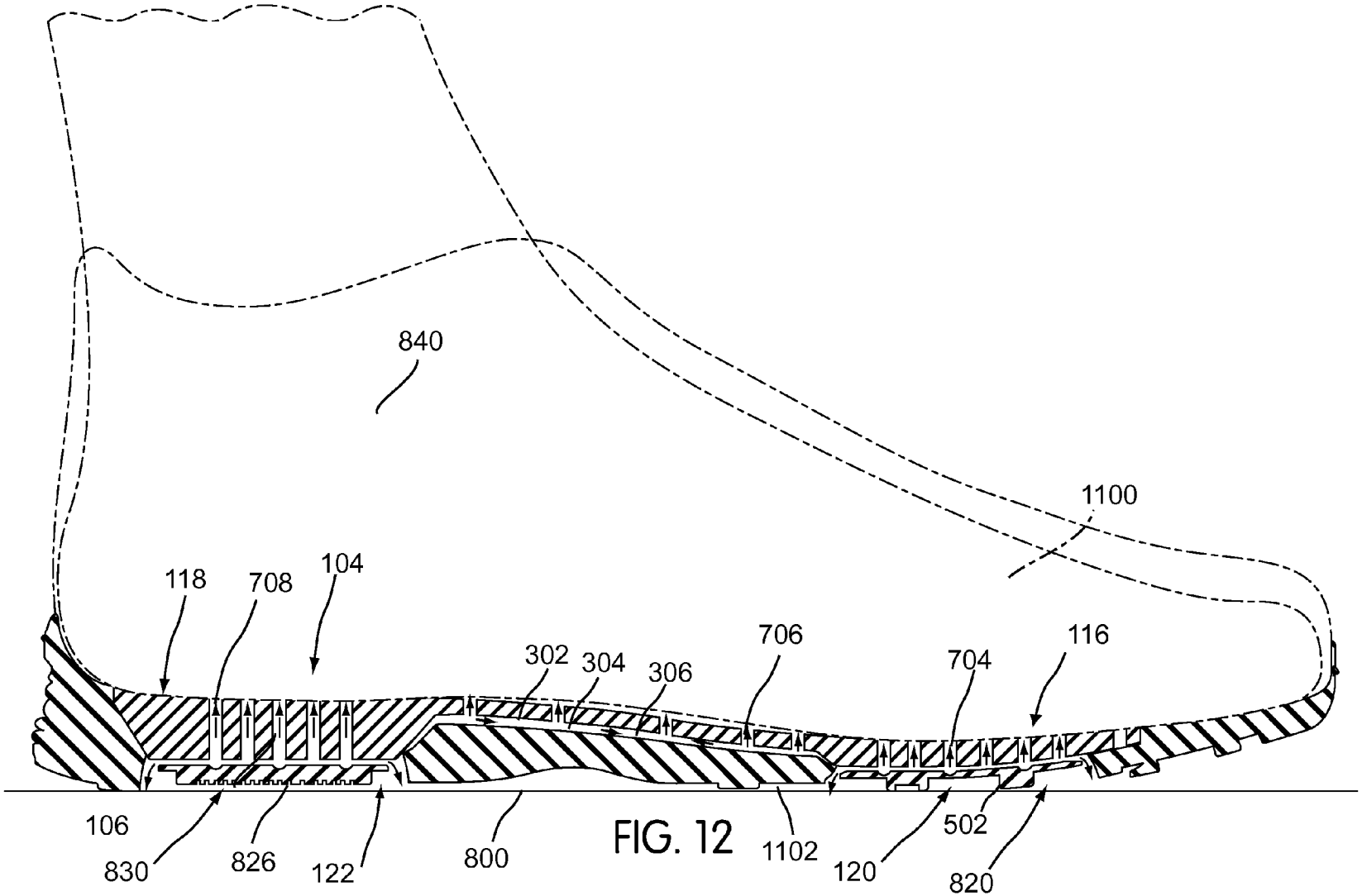
FIG. 12 is a side view of a preferred embodiment of a sole system during compression.

FIGS. 10 and 11 are intended to be schematic representations of the basic motions of first compression chamber 820 and second compression chamber 830. The apertures disposed along the upper sole portion in previous figures are not shown here to improve clarity. In a preferred embodiment, first projecting portion 116 and second projecting portion 118 will both include a system of apertures as shown in FIGS. 9 and 12. Furthermore, while FIGS. 10 and 11 are shown with respect to second compression chamber 830, the operation of first compression chamber 820 would be substantially similar. That is, the volume of air initially confined within first compression chamber 820 would be reduced as first lower surface 826 approaches surface 800.

This reduction in volume, of both compression chambers 820 and 830, creates a pressure imbalance that facilitates the exchange of air between the inside of the upper and the outside air. In particular, this change in volume forces air through the apertures and channels disposed along upper sole portion 104. FIG. 12 is a side cross sectional view of a preferred embodiment of article of footwear 100, once a wearer's foot 1100 has been inserted and is applying force to upper sole portion 104. In this embodiment, first projecting portion 116 and second projecting portion 118 have been inserted further into first hole 120 and second hole 122, reducing the volume of air in first compression chamber 820 and second compression chamber 830.

The arrows in FIG. 12 represent the exchange of air between first compression chamber 820, second compression chamber 830, and enclosed region 840 of upper 102. In addition, as upper sole portion 104 depresses, lower surface 826 of first projecting portion 116 eventually contacts surface 800. During this compression step, air is preferably moved through first aperture region 704, second aperture region 706, and third aperture region 708. Additionally, air is also preferably moved through first channel 302, second channel 304, and third channel 306.

Because first projecting portion 116 includes tread elements 502, first projecting portion 116 provides traction between the article of footwear and surface 800. In some embodiments, first projecting portion 116 need not contact surface 800. Instead, first projecting portion 116 may approach outer surface 1102 of lower sole portion 106 but fail to contact surface 800. In situations where first projecting portion 116 contact surface 800, lower surface 826 of first projecting portion 116 may be flush with outer surface 1102 of lower sole portion 106.

Additionally, as the force is removed from upper sole portion 104, the volume of air in first compression chamber 820 and second compression chamber 830 increases. This increase in the volumes of air creates another pressure difference that causes air to flow in the reverse direction. With each step the wearer of the article of footwear is imposing a force, and then releasing the force, creating an alternating exchange of air between first compression chamber 820, second compression chamber 830 and enclosed region 840 of article of footwear 100. Since wearer's foot 1100 is preferably disposed within enclosed region 840, the air proximate to wearer's foot 1100 is constantly being circulated and cooled.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claim is:

1. An article of footwear, comprising:

an upper;

an upper sole portion including an upper sole portion body and a projecting portion extending from a first side of the upper sole portion body;

the upper sole portion including at least one aperture;

a lower sole portion including a first side configured to contact the upper sole portion body and a second side configured to contact a ground surface;

the lower sole portion including a hole, the hole configured to extend through the lower sole portion from the first side to the second side and is further configured to receive the projecting portion of the upper sole portion;

a compression chamber defined by a lower surface of the projecting portion and at least one wall of the hole extending through the lower sole portion;

the compression chamber having a first volume;

wherein the compression chamber has a second volume after being compressed and wherein the change in volume forces air through the at least one aperture;

wherein the lower sole portion includes at least one channel; and wherein the channel corresponds to the aperture.

2. The article of footwear according to claim 1, wherein the upper sole portion includes a first projecting portion and a second projecting portion.

3. The article of footwear according to claim 2, wherein the first projecting portion corresponds to a forefoot region of the upper sole portion.

4. The article of footwear according to claim 2, wherein the second projecting portion corresponds to a heel region of the upper sole portion.

5. The article of footwear according to claim 1, wherein the projecting portion is configured to move within the hole between a first distance from the second side of the lower sole portion when the lower sole portion is uncompressed and a second distance from the second side of the lower sole portion when the lower sole portion is compressed, the second distance being smaller than the first distance; and wherein a first side of the projecting portion includes at least one tread element.

6. The article of footwear according to claim 5, wherein a first surface of the projecting portion is composed of a similar material as the second side of the lower sole portion.

7. The article of footwear according to claim 5, wherein the lower sole portion includes at least one tread element disposed along the second side.

8. The article of footwear according to claim 7, wherein the tread element disposed along the projecting portion is composed of the same material as the tread element disposed along the second side of the lower sole portion.

9. The article of footwear according to claim 5, wherein the first side of the projecting portion includes multiple tread elements.

10. The article of footwear according to claim 5, wherein the tread element disposed along the first side of the projecting portion increases traction between the article of footwear and a surface.

11. The article of footwear according to claim 5, wherein the upper sole portion includes a second projecting portion, including a second tread element disposed along a first side of the second projecting portion.

* * * * *